United States Patent [19]

Candino

[11] Patent Number: 4,901,943

[45] Date of Patent: Feb. 20, 1990

[54] APPARATUS FOR DISPENSING THREAD FROM A SPOOL

[76] Inventor: Domenico Candino, 2100 Finnegan Dr., Elma, N.Y. 14059

[21] Appl. No.: 227,553

[22] Filed: Aug. 3, 1988

Related U.S. Application Data

[62] Division of Ser. No. 28,181, Mar. 19, 1987, Pat. No. 4,771,798.

[51] Int. Cl.[4] ..... B65H 59/22

[52] U.S. Cl. ..... 242/150 R

[58] Field of Search ..... 242/150 R, 150 M, 149, 242/147 R

[56] References Cited

U.S. PATENT DOCUMENTS

| | | | |
|---|---|---|---|
| 467,103 | 1/1892 | Huse | 242/150 R |
| 493,871 | 3/1893 | Merrow | 242/150 R |
| 1,385,189 | 7/1921 | Pigeon | 242/150 R |
| 1,996,964 | 4/1935 | Hutton | 242/150 R |
| 2,232,262 | 2/1941 | Parkinson | 242/150 R |
| 2,681,772 | 6/1954 | Charney | 242/150 R |

FOREIGN PATENT DOCUMENTS

| | | | |
|---|---|---|---|
| 142889 | 11/1902 | Fed. Rep. of Germany | 242/150 R |
| 610326 | 6/1926 | France | 242/150 R |
| 28194 | 5/1903 | Switzerland | 242/150 R |
| 122040 | 1/1919 | United Kingdom | 242/150 R |

*Primary Examiner*—Stanley N. Gilreath
*Attorney, Agent, or Firm*—Edwin T. Bean, Jr.; Martin G. Linihan; John C. Thompson

[57] ABSTRACT

Apparatus for dispensing at least one thread to the head of a recipient of a hair replacement unit for interweaving the thread with the recipient's natural hair comprising a housing including a front wall defining an opening and including a cavity for supporting a spool of thread and at least one thread-tensioning device including a bracket mounted within the cavity and against a wall of the housing defining a thread-accepting aperture, a pair of washers mounted adjacent the thread-accepting aperture each having a convex surface and arranged so that the convex surfaces face and engage one another so as to define an annular groove therebetween, and a spring for biasing the washers in engagement with one another so that thread routed from the thread spool can be routed through the thread-tensioning device so that the thread extends through the thread-accepting aperture in one direction, around the washers so as to extend through a section of the annular groove defined therebetween, and back through the thread-accepting aperture in the other direction and out of said front wall opening to provide tension on the thread dispensed to the recipient's head.

4 Claims, 2 Drawing Sheets

Fig. 1.
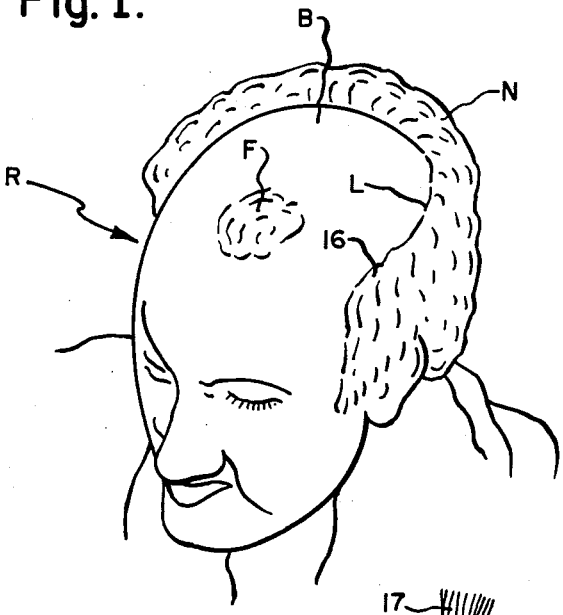
Fig. 9.
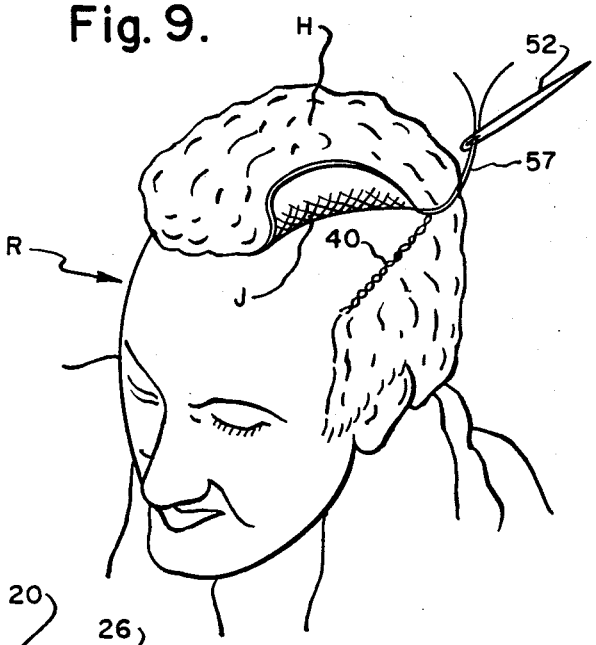
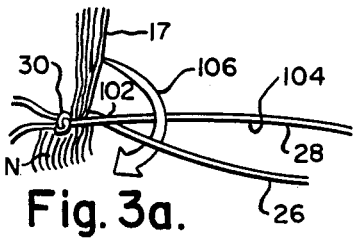
Fig. 3a.
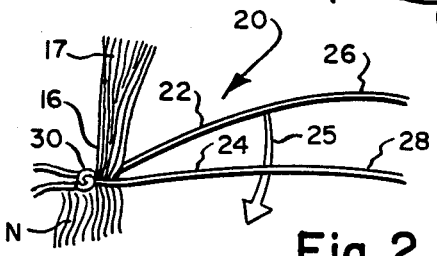
Fig. 2.
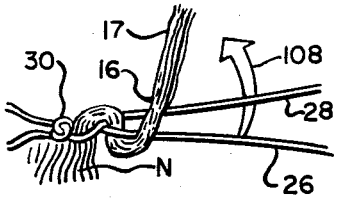
Fig. 3b.
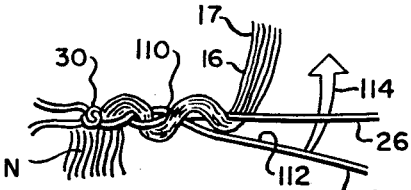
Fig. 3c.
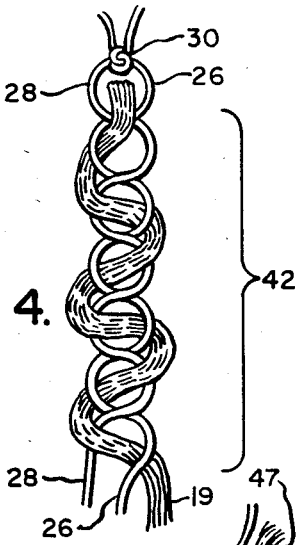
Fig. 4.
Fig. 5.
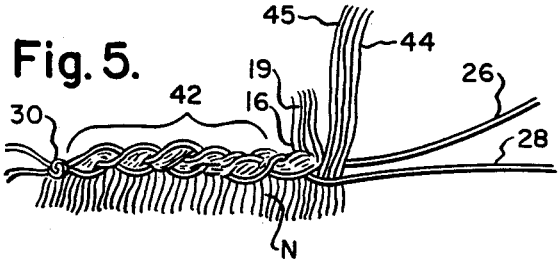
Fig. 6.
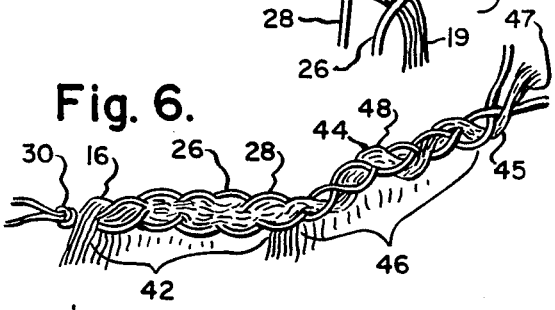
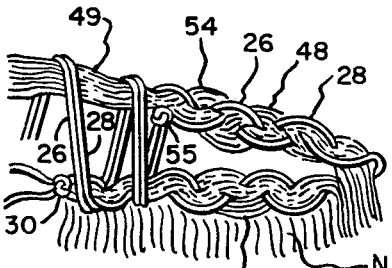
Fig. 7.
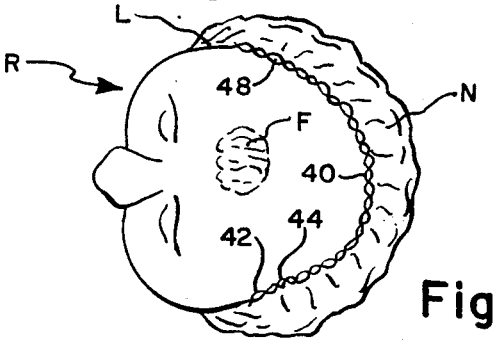
Fig. 8.

APPARATUS FOR DISPENSING THREAD FROM A SPOOL

This is a divisional of application Ser. No. 028,181, filed March 19, 1987, now U.S. Pat. No. 4,771,798.

BACKGROUND OF THE INVENTION

This invention relates generally to hair replacement units and hairpieces and relates more particularly to a technique by which a hair replacement unit can be attached to the head of a recipient, such as a balding person, by means of a non-surgical "Permanently-Rooted Hair Retention System".

It is known that in order to attach a hair replacement unit to the head of a recipient wherein the recipient retains at least some natural hair, tufts of the recipient's natural hair can be intertwined with a filament or thread to form a securing ring or anchoring braid about the head of the recipient. By subsequently attaching the hair replacement unit to the securing ring, the unit is anchored to the head. Examples of attachment methods for forming such securing rings are described in U.S. Pat. Nos. 3,871,389 and 4,372,330.

One such method, described in the latter of the referenced patents and with which the present invention is to be compared, includes the steps of anchoring a pair of juxtaposed filament pieces to a first tuft of gathered natural hair, twisting the members of the filament pair about each other to form a first winding, positioning a second tuft of natural hair between the filament pair and twisting the filament hair about one another so as to form a second winding. The process of gathering natural hair into tufts and twisting the filament hair about each gathered tuft is repeated until an anchoring braid of desired length is formed wherein each gathered tuft is locked between successive windings of the filament pair.

It is an object of the present invention to provide a new and improved technique or method for forming an anchoring braid with the natural hair of a recipient of a hair replacement unit.

Another object of the present invention is to provide such a technique providing an improved anchoring braid for anchoring a hair replacement unit to the head of a recipient.

Still another object of the present invention is to provide such a technique which can be carried out quickly and with relative ease.

A yet still further object of the present invention is to provide such a technique of attaching a hair replacement unit without surgery or auxiliary attaching devices such as hair clips or pins.

A further object of the present invention is to provide a "Permanently-Rooted Hair Retention System" for firmly securing an artificial hair replacement unit to the recipient's own natural hair.

A still further object of the present invention is to provide such a hair retention system which is both strong and durable.

A yet still further object of the present invention is to provide a new and improved dispenser for dispensing filament to the recipient's head at the site of the braid-forming operation.

SUMMARY OF THE INVENTION

This invention resides in a new and improved technique or method for forming a securement braid with the natural hair of a recipient, such as a balding person, to which braid a hair replacement unit can be attached, an associated technique of attaching a hair replacement unit to the head of the wearer and associated apparatus facilitating the braid-forming operation.

The technique for forming a securement braid includes initial steps of providing thread means including two joined stretches of filament for interweaving with the natural hair of the recipient and gathering several strands of the recipient's natural hair into a first tuft. The thread means are then placed about the first tuft adjacent the scalp of the recipient and the two filament stretches are arranged on opposite sides of the first tuft and in juxtaposed relationship with one another so as to be directed generally tangentially of the scalp. The first tuft is arranged between the two filament stretches so that the free end of the first tuft is directed generally perpendicular to the scalp. The first tuft and the two filament stretches are then braided together by (a) crossing the two filament stretches adjacent the first tuft so that a first of the filament stretches passes beneath the second of the filament stretches at the crossing thereof and so that a first spacing is provided between the two filament stretches remote of the crossing thereof, (b) passing the free end of the first tuft between the first spacing and tightly around the first of the filament stretches and reorienting the free end of the tuft generally perpendicular to the scalp, (c) crossing the two filament stretches adjacent the first tuft so that the first of the filament stretches passes beneath the second of the filament stretches at the crossing thereof and so that a second spacing is defined between the two filament stretches remote of the crossing thereof, and (d) passing the free end of the first tuft through the second spacing and around the first of the filament stretches and reorienting the free end of the tuft generally perpendicular to the scalp and (e) repeating steps (a) through (d) at least once to form a first braid section of the securement braid.

Several strands of the recipient's natural hair are then gathered into a second tuft, the free end of the first tuft is gathered with the second tuft in a single cluster, and the thread means are positioned about the second tuft, or single cluster, so that the two filament stretches are arranged on opposite sides of the second tuft adjacent the scalp and in juxtaposed relationship with one another so as to be directed generally tangentially of the scalp. The second tuft is arranged between the two filament stretches so that the free end of the second tuft is directed generally perpendicular to the scalp. Steps (a) through (d) above are thereafter repeated using the second tuft to form a second braid section of the securement braid including the two filament stretches and the second tuft. The second braid section is then tied off, or otherwise finished, to prevent the braid sections from unraveling.

An associated technique for attaching a hair replacement unit to the securement braid includes the steps of positioning a hair replacement unit in operative overlying relationship with the head of the recipient and anchoring the hair replacement unit to the securement braid to thereby attach the hair unit to the recipient's head.

An associated apparatus for dispensing at least one thread to the head of the unit recipient for interweaving the thread with the recipient's natural hair includes housing means for supporting a spool and at least one thread-tensioning means mounted within the housing means. The housing means includes means defining a front, a back, a top, a bottom and side walls between which is defined a cavity for supporting a spool of thread, and the front wall defines an opening. The thread-tensioning means includes means mounted within the cavity and against the top wall of the housing means defining a thread-accepting aperture, a pair of washers mounted adjacent the thread-accepting aperture and means for biasing the washers in engagement with one another. Each of the washers have a convex surface, and the washers are arranged so that the convex surfaces face and engage one another so as to define an annular groove therebetween. Thread routed from the spool is routed through the thread-tensioning means so that the thread extends through the thread-accepting aperture in one direction, around the washers so as to extend through a section of the annular groove defined therebetween and back through the thread-accepting aperture in the other direction and out of the front wall opening to provide tension on the thread dispensed to the recipient's head.

BRIEF DESCRIPTION OF THE DRAWING FIGURES

FIG. 1 is a perspective view of a partially bald man prior to the attachment of a securement braid in accordance with the technique of this invention.

FIG. 2 is a perspective view of a first tuft of hair of the FIG. 1 man and two thread filaments operatively positioned alongside the first tuft.

FIG. *3a–3c* are perspective views similar to that of FIG. 2 illustrating steps involved in braiding the thread filaments and first tuft of FIG. 2 together in accordance with the technique of this invention.

FIG. 4 is a perspective view of the first tuft and thread filaments after being braided to form a first braid section of the securement braid and rotated generally ninety degrees from the view of FIG. 2 for illustrating the interwoven relationship between the first tuft and thread filaments.

FIG. 5 is a view similar to FIG. 2 of the braid section formed with the tuft and thread filaments of FIG. 2 and a second tuft of hair about which the thread filaments are operatively positioned.

FIG. 6 is a view similar to FIG. 5 illustrating the interwoven relationship between the second tuft and thread filaments braided in accordance with the method of this invention.

FIG. 7 is a perspective view illustrating the finishing of the securement braid.

FIG. 8 is a plan view of the FIG. 1 man once the securement braid has been formed in his hair.

FIG. 9 is a perspective view similar to that of FIG. 1 illustrating the attachment of a hair replacement unit to the completed FIG. 8 securement braid.

Figure 10:
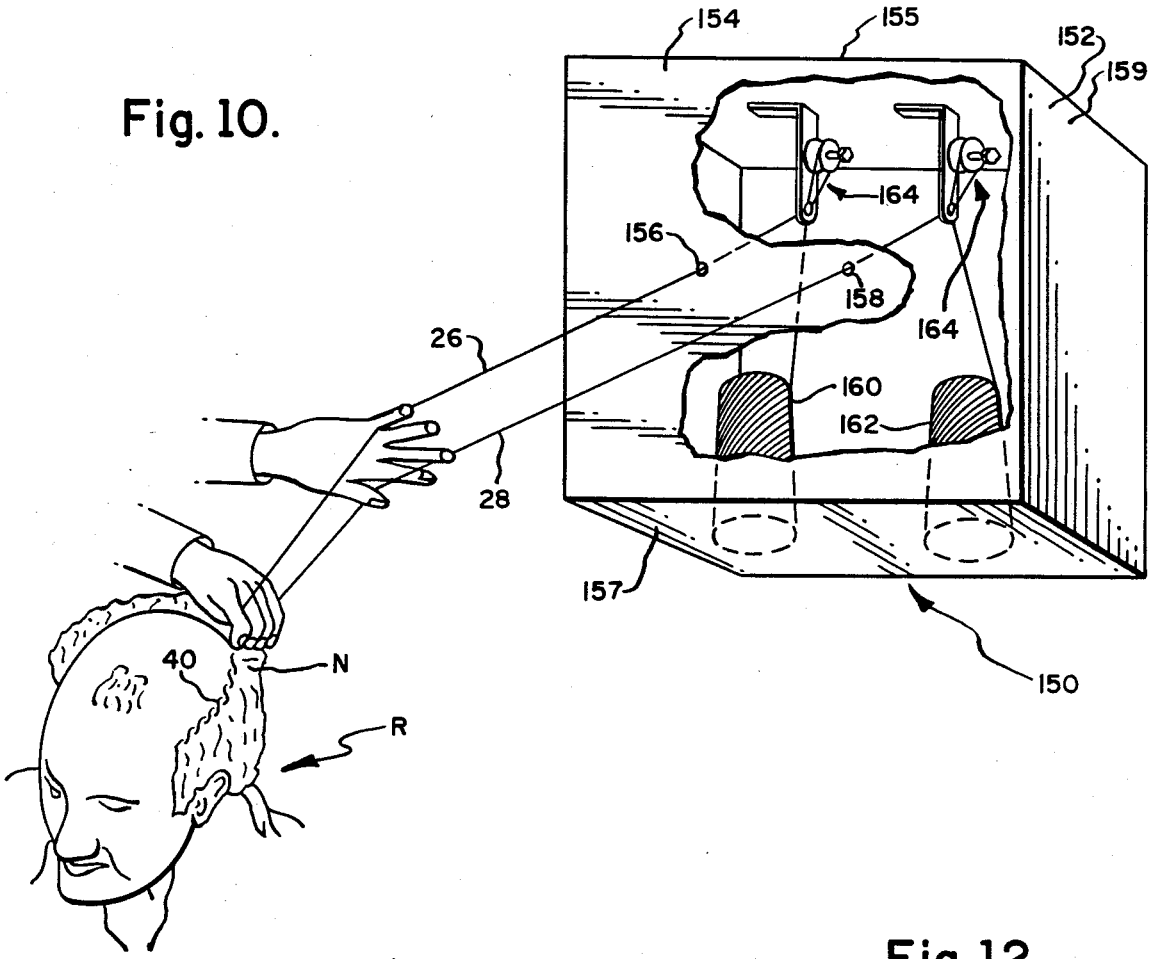

FIG. 10 is a perspective view of a thread-dispensing apparatus, shown partially cut-away, for dispensing two threads to the site of a braid-forming operation.

Figure 11:
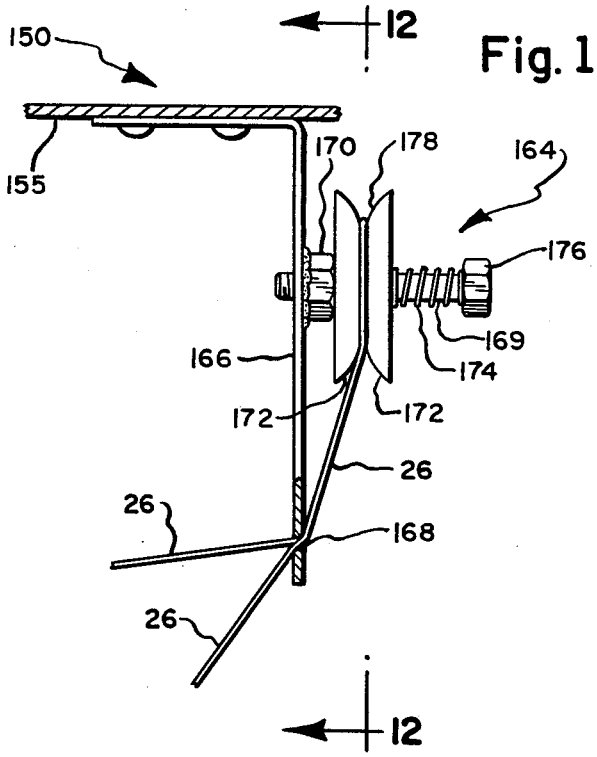

FIG. 11 is an elevation view of one of the thread-tensioning mechanisms of the FIG. 10 apparatus.

Figure 12:
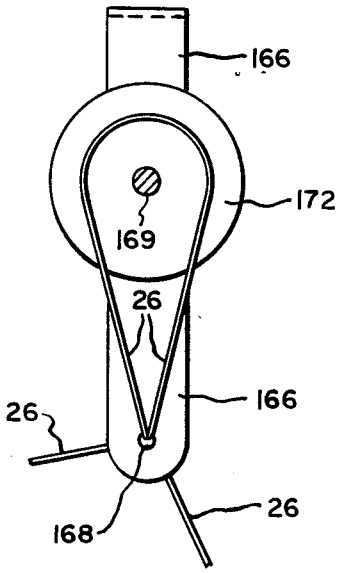

FIG. 12 is a cross-sectional view taken about on lines 12—12 of FIG. 11.

DETAILED DESCRIPTION OF A PREFERRED EMBODIMENT

Turning now to the drawings in greater detail and considering first FIG. 1, there is shown the head of a hair replacement recipient R to which a hair replacement unit H (FIG. 9) can be attached in accordance with the technique or method of the present invention. The recipient R possesses a bald or balding region B on top of his head and a quantity of natural hair N around the sides and back of the head so that a hairline L extends a substantial distance around the head of the recipient R. As will be apparent hereinafter, it is with the natural hair N of the recipient R that the hair replacement unit H is anchored to the head.

In accordance with the steps of the technique of the present invention and with reference to FIG. 2, thread means, generally indicated 20, are provided which include two filament stretches 22,24 for interweaving with the natural hair N. In the embodiment of the thread means 20 shown, the two filament stretches 22,24 are in the form of a pair of lubricated translucent threads 26,28, respectively, which are tied or joined together at one end thereof to form a knot 30. The threads 26 and 28 are each comprised of a filament of the type commonly used in hair-weaving operations and are preferably tied together at the knot 30 at least three times for securely bonding the threads 26,28 together. Furthermore, the threads 26 and 28 can be conveniently administered to the recipient's head from a spool-carrying filament dispenser described hereinafter.

Several strands of the recipient's natural hair N located adjacent the hairline L or region B of the head are then isolated and gathered into a first tuft 16. As will be apparent hereinafter, the first tuft 16 is one of several tufts gathered for the purpose of interweaving with the threads 26 and 28 and thereby forming a securement or anchor braid 40 (FIG. 8) to which the hair replacement unit H is attached. As illustrated in FIG. 1, the first tuft 16 is isolated adjacent the recipient's left temple, and as is apparent from FIG. 8, the planned path for the securement braid 40 extends from a location adjacent one temple and around the back of the head to a location adjacent the other temple. It will be understood, however, that the first tuft 16 may be isolated adjacent the recipient's right temple in preparation of a securement braid expected to extend around the back of the head to a location adjacent the right temple. Whether the operator (i.e., weaver) begins the securement braid 40 on the right or left side of the head may depend upon whether the operator is right handed or left handed.

With reference again to FIG. 2, the threads 26,28 are then operatively positioned about the first tuft 16 by looping the knot 30 about the base of the tuft 16 adjacent the recipient's scalp and drawing the threads 26,28 in a relatively taut condition thereabout so that the knot 30 abuttingly engages the tuft 16 and the tuft 16 is maintained in a gathered arrangement between the threads 26,28. As shown in FIG. 2, the threads 26,28 are arranged about the first tuft 16 in a juxtaposed relationship with one another so as to be directed generally tangentially of the surface of the scalp of the recipient, and the tuft 16 is arranged between the two threads 26,28 so that the free end, indicated 17, of the tuft 16 is directed generally perpendicular to the scalp.

With the tuft 16 and threads 26,28 arranged as aforedescribed and as shown in FIG. 2, the tuft 16 and threads 26,28 are braided together in the manner illustrated in FIGS. *3a–3c*. More specifically and to begin the braiding operation, the thread 26 is moved or crossed relative to the thread 28 in the direction of the FIG. 2 arrow 25 so that the thread 26 passes beneath the thread 28 and crosses the thread 28 at a location of crossing, indicated 102 in FIG. *3a*. The aforedescribed crossing step positions the location of crossing 102 adjacent the tuft 16 so that the tuft 16 is tightly held between the crossing 102 and the knot 30 and so that there is a spacing, indicated 104, defined between the threads 26,28 remote of the crossing 102. As shown in FIG. 3*a*, the free end 17 of the tuft 16 is then moved in the direction of the arrow 106 to pass the tuft 16 between the spacing 104 and tightly around the filament 26 and reorienting the free end 17 generally perpendicular to the scalp. The aforedescribed steps of passing and reorienting the tuft 16 arranges the tuft 16 relative to the threads 26,28 as shown in FIG. 3*b*.

The thread 26 is then moved or crossed relative to the thread 28 in the direction of the arrow 108 of FIG. 3*b* so that the thread 26 passes beneath the thread 28 and crosses the thread 28 at a location of crossing, indicated 110 in FIG. 3*c*. Such a crossing step positions the location of crossing 110 adjacent the tuft 16 so that there is a spacing 112 defined between the threads 26,28 remote of the crossing 110. With reference still to FIG. 3*c*, the free end 17 is then passed in the direction of the arrow 114 through the spacing 112 and around the thread 26 and reoriented generally perpendicular to the scalp as shown.

At that point, the aforedescribed crossing and passing steps are repeated twice to complete a first braid section 42 as shown in FIG. 4. During the first repeat of the braid cycle, the thread 26 is crossed beneath the thread 28, the tuft free end 17 is passed between the threads 26,28 and around the thread 26, the thread 26 is crossed beneath the thread 28 and the tuft free end 17 is again passed between the threads 26,28 and around the thread 26. During the second and last repeat of the braid cycle, the thread 26 is crossed beneath the thread 28, the tuft free end 17 is passed between the threads 26,28 and around the thread 28, and the tuft free end 17 is again passed between the threads 26,28 and around the thread 26. The threads 26,28 are thereby securely interwoven with the tuft 16, and the tuft 16 is securely interwoven with the threads 26,28 so that the tufts 16 and threads 26,28 are arranged in a somewhat regular diagonal pattern along the length of the braid section 42. The first braid section 42 is shown in FIG. 4 in a loosened condition for purposes of understanding, but it will be understood that as the tuft 16 and threads 26,28 are braided as aforedescribed, the braid weave is maintained in a relatively tight or taut condition so that the weave of the braid section 42 is relatively tight when completed.

Upon completion of the first braid section 42, the remaining or unbraided portion of the first tuft 16 extends from an end of the first braid section 42 so as to define a free end portion 19 of the tuft 16. Of course, the length of the hair in the first tuft 16 and the number of times that the braiding cycle is performed during the section-forming process will dictate how long the free end portion 19 of the tuft 16 is upon completion of the braid section 42, but it is preferred that the free end portion 19 be at least about 0.5 inches (1.3 cm) long upon completion of the section 42 for a reason hereinafter apparent.

Following completion of the first braid section 42 and with reference to FIG. 5, several strands of the recipient's natural hair N located rearwardly of and adjacent the first tuft 16 are gathered into a second tuft 44, and the second tuft 44 is gathered or placed against the remainder or free end portion 19 of the first tuft 16 so that an end of the first braid section 42 generally abuts the base of the second tuft 44. The free ends of the threads 26,28 are then positioned on opposite sides of the tuft 44 and in a juxtaposed relationship with one another as shown in FIG. 5. More specifically, the threads 26,28 are arranged on opposite sides of the tuft 44 so as to be directed generally tangentically to the scalp, and the tuft 44 is arranged generally perpendicular to the scalp. The second tuft 44 and threads 26,28 are then braided together to form a second braid section 46 (FIG. 6) of the securement braid 40 (FIG. 8) in the identical manner that the first tuft 16 and threads 26,28 were braided together, as aforedescribed, to form the first braid section 42. In other words and to complete one braid cycle, the thread 26 is crossed beneath the thread 28, the free end, indicated 45 in FIG. 5, of the tuft 44 is passed between the crossed threads 26,28 and around the thread 26 and reoriented so as to be directed generally perpendicular to the scalp, the threads 26,28 are crossed again so that the thread 26 passes beneath the thread 28, and the tuft free end 45 is passed between the crossed threads 26,28 and around the thread 26 and reoriented generally perpendicular to the scalp. The aforedescribed braid cycle is repeated twice to securely interweave the tuft 44 and threads 26,28 together and so that the resultant second braid section 46 (FIG. 6) resembles in appearance the earlier-formed first braid section 42 (FIG. 5). Furthermore, the entire length of the tuft free end portion 19 is commonly interwoven within the second braid section 46 (FIG. 6) during the formation thereof, and a portion or unbraided section, indicated 47, of the tuft 44 extends from an end of the completed second braid section 46.

The aforesaid steps of gathering several strands of natural hair N into a tuft, positioning the free end or unbraided portion of the tuft protruding from the precedingly-formed braid section in gathered relationship with the tuft, operatively positioning the free ends of the threads 26,28 on opposite sides of the tuft in preparation of a subsequent braiding operation, and braiding the threads 26,28 and tuft together are repeated with successive tufts located along the recipient's hairline L until the final or last braid section, indicated 48 in FIGS. 7 and 8, of the securement braid 40 has been formed. It will be understood from the foregoing that each tuft gathered and braided in sequence with the threads 26,28 is arranged in close proximity to an adjacently-gathered tuft. The number of tufts gathered for the purpose of braiding with the threads 26,28 can depend largely upon the length and thickness of the recipient's hair, the amount of braid necessary to satisfactorily secure the hair replacement unit H (FIG. 9) to the recipient's head, and on the circumference of the recipient's balding area. Commonly, however, a typical number of braid sections in a single securement braid may fall in the range of twenty-five to fifty.

With reference to FIG. 7, the final braid section 48 is finished by tying at least three knots, indicated 55, in the two threads 26,28 at the end, indicated 54, of the final braid section 48 to prevent the braid section 48 from unraveling. By knotting the threads 26,28 at the braid end 54 to prevent the final braid section 48 from unraveling, each formed braid section in the braid 40 is prevented from unraveling. The final braid section 48 is then folded back across so as to overlie the preceding braid section and sewn to the preceding braid section, indicated 50, by repeatedly wrapping and knotting the threads 26,28 about the braid section 50 and the free or unbraided end of the tuft, indicated 49, of the braid section to effectively sew the tuft 49 and braid sections 50 together. To this end, the threads 26,28 are threaded through to a needle (not shown in FIG. 7) and wrapped about both the tuft free end 49 and braid section 50 as the needle is guided therearound so that the threads 26,28 spiral around the tuft free end 49 and braid section 50 from the braid section end 54 to the end of the tuft free end 49 where the threads 26,28 are subsequently knotted. Preferably, each successive wrap of the threads 26,28 is knotted so that if the portion of the threads 26,28 wrapped thereabout happens to break, the knots formed in the threads 26,28 located on the section-side of the break prevent the braid sections 48,50 from coming apart. Once the tuft 49 and braid section 50 are secured as aforesaid, excess portions of the threads 26,28 protruding beyond the finally-formed knot are cut off.

With reference to FIG. 9, the hair replacement unit H is operatively attached to the recipient's head by positioning the unit H in overlying relationship with the bald region B of the recipient's head and sewing the unit H to the securement braid 40. More specifically, a needle 52 and thread sections, such as the one indicated 57, are utilized to bind the unit H and braid 40 together at selected locations along the length of the braid 40 by repeatedly passing the needle 52, with thread section 57, through the base element, indicated J and commonly constructed of a mesh material, of the unit H and between the securement braid 40 and scalp of the recipient R in a wrapping fashion to effectively sew the unit H to the braid 40. Preferably, each successive wrap of the thread section 57 is knotted to prevent the unit H from loosening if the thread section 57 breaks. Each thread section 57 can be comprised of a single or a double strand of thread for purposes of sewing the unit H to the braid 40. After sewing the hair replacement unit H to the braid 40 with a thread section 57, the thread section 57 is knotted to maintain the unit H and braid 40 in a sewn-together condition.

As suggested earlier the threads 26 and 28 can be conveniently administered to the site of the braid-forming operation from a filament dispenser. Such a dispenser is indicated 150 in FIG. 10 and is constructed to provide a desirable amount of tension on the threads 26,28. More specifically, the dispenser includes housing means in the form of a box 152 having a front wall 154, a top wall 155, a bottom wall 157 and sidewalls 159,159. The front wall 154 is hingedly connected to the remainder of the box 152 and defines two openings 156,158. Two cone-shaped spools 160,162 of thread rest upon the bottom 157 of the box 152 in the manner shown, and two tension-providing means 164,164 are positioned within and attached to the top 155 of the box 152. Each tension-providing means 164, best illustrated in FIG. 11, includes an L-shaped bracket 166 having one leg attached with screws to the top 155 of the box 152 and an aperture 168 defined in the free end of the unattached leg. A threaded shank 169 is fixed at one end to the unattached bracket leg so as to extend at a right angle thereto.

Mounted upon the shank 169 is a spacer 170, two washers 172,172 a compression spring 174, and a nut 176. The spacer 170 is in the form of a ring which spaces the washers 172,172 from the bracket 166, and the spring 174 is positioned between the washers 172,172 and the nut 176. Each washer 172 or 172 defines a convex surface and are arranged in engagement so that the convex surfaces face one another as shown and thereby define a thread-receiving groove 178 therearound. The thread routed from a spool extends through the aperture 168 in one direction, is positioned within the groove 178 so as to extend for a substantial distance but not completely around the washers 172,172 as best shown in FIG. 12, extends through the aperture 168 in the opposite direction, and out of the box 152 through a corresponding opening 156 or 158. By not looping the threads 26,28 completely around the corresponding pair of washers 172,172, neither of the threads 26 or 28 crosses itself before returning through the aperture 168.

By re-positioning the nut 176 upon the length of the shank 169, the strength of the spring force exerted upon the washers 172,172 is adjusted, and the compression force exerted by the washers 172,172 upon the thread extending through the groove 178 is adjusted. By adjusting the aforesaid compression force, the amount of tension required to draw or pull the thread from its spool is thereby adjusted. Hence, the nut 176 provides means by an operator can preselect the tension force exerted by a thread in opposition to the force required to pull the thread to the head of the recipient.

As the threads 26,28 are dispensed from the dispenser 150 in the manner illustrated in FIG. 10, the operator moves each selected tuft through and around the threads 26,28 in a braiding operation. It has been found that by alternatively crossing one thread beneath the other in one direction or the other and passing the selected tuft back and forth between the fingers of one hand to the fingers of the other hand through the spacing defined between the threads after each crossing thereof, the braiding process can be performed quickly and efficiently. Furthermore, the threads 26,28 dispensed from the dispenser 150 cannot become entangled during a braiding operation performed in accordance with the technique of this invention because two successive thread-crossing steps returns the threads 26,28 to the thread positions assumed before the thread-crossing steps were performed as illustrated in FIG. 3*c*.

It will be understood that numerous modifications and substitutions can be had to the aforedescribed embodiment without departing from the spirit of the invention. For example, although the aforedescribed method has been shown and described as utilized for forming a single securement braid 40 extending around the recipient's head from one temple to the other, it will be understood that the steps of this invention can be used to form any of a number of securement braids upon a single head. For example and with reference to FIG. 1, an additional securement braid can be formed with natural hair located on the front of the wearer's head and indicated F. A braid formed with hair F may be desired as an additional braid to which the hair replacement unit H can be sewn and thereby anchored. Accordingly, the aforedescribed embodiment is intended for the purpose of illustration and not as limitation.

I claim:

1. An apparatus for dispensing at least one thread to the head of a recipient of a hair replacement unit for interweaving the thread with the recipient's natural hair comprising:

housing means including means defining a front, a back, a top, a bottom and side walls between which is defined a cavity for supporting a spool of thread, said front wall defining an opening;

at least one thread-tensioning means including means mounted within said cavity and against the top wall of said housing means defining a thread-accepting aperture, a pair of washers mounted adjacent said thread-accepting aperture each having a convex surface and arranged so that the convex surfaces face and engage one another so as to define an annular groove therebetween, and means for biasing the washers in engagement with one another;

a spool containing thread; and said thread extending from said spool and being routed through said thread-tensioning means so that the thread extends though said thread-accepting aperture in one direction, around only the washers and so as to extend continuously along a major portion of the circumferential length of the annular groove defined therebetween, and back through said thread-accepting aperture in the other direction at an acute angle with respect to the first direction and out of said front wall opening to provide tension on the thread dispensed to the recipient's head.

2. An apparatus as defined in claim 1 wherein said means mounted within said cavity includes a bracket defining said thread-accepting aperture and shank means connected to said bracket for supporting said washers and wherein said biasing means comprises a spring.

3. An apparatus as defined in claim 2 wherein one side of said pair of washers is maintained in position by said bracket, said shank means includes an externally-threaded shank, said spring is positioned upon said shank so that said washers are positioned between said spring and said bracket, and said thread-tensioning means includes a nut threadably accepted upon said shank so that said spring acts between said washers and said nut to bias said washers together and so that adjustment of said nut along the length of said shank adjusts the compressive force between said washers and thereby adjusts the tension of said thread.

4. An apparatus as defined in claim 1 wherein said cavity of said housing means is of such size to support two thread spools positioned therein and there are two thread-tensioning means mounted in the top wall of said housing means for maintaining tension in thread drawn from two spools positioned within the housing means wherein the thread from each of the two spools is routed through a corresponding one of said two thread-tensioning means.

* * * * *